US012181240B2

(12) United States Patent
Ribic et al.

(10) Patent No.: US 12,181,240 B2
(45) **Date of Patent: *Dec. 31, 2024**

(54) SLIDE ASSEMBLY FOR A FIREARM

(71) Applicant: Shadow Systems LLC, Plano, TX (US)

(72) Inventors: Anthony Joseph Ribic, Richardson, TX (US); Richard Trevor Simpson Roe, Plano, TX (US)

(73) Assignee: Shadow Systems LLC, Plano, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/368,615

(22) Filed: Sep. 15, 2023

(65) Prior Publication Data

US 2024/0003642 A1 Jan. 4, 2024

Related U.S. Application Data

(63) Continuation of application No. 17/339,313, filed on Jun. 4, 2021, now Pat. No. 11,796,264, which is a continuation of application No. 16/746,468, filed on Jan. 17, 2020, now Pat. No. 11,067,348.

(51) Int. Cl.

| | |
|---|---|
| ***F41A 3/26*** | (2006.01) |
| ***F41A 3/66*** | (2006.01) |
| ***F41C 3/00*** | (2006.01) |

(52) U.S. Cl.

CPC ..... *F41A 3/26* (2013.01); *F41A 3/66* (2013.01); *F41C 3/00* (2013.01)

(58) Field of Classification Search

CPC ..... F41A 3/26

See application file for complete search history.

(56) References Cited

U.S. PATENT DOCUMENTS

| | | | | |
|---|---|---|---|---|
| 8,984,787 | B1 | 3/2015 | O'Clair et al. | |
| RE47,335 | E | 4/2019 | Wolf | |
| 11,067,348 | B1 * | 7/2021 | Ribic | F41G 1/30 |
| 11,796,264 | B2 * | 10/2023 | Ribic | F41G 1/30 |
| 2014/0137454 | A1 | 5/2014 | Lee | |
| 2014/0230305 | A1 | 8/2014 | Zimmer | |
| 2017/0059277 | A1 | 3/2017 | Justice | |
| 2019/0049217 | A1 | 2/2019 | Costet et al. | |
| 2019/0331461 | A1 | 10/2019 | Zimmer | |
| 2020/0208931 | A1 | 7/2020 | Weilharter | |

(Continued)

FOREIGN PATENT DOCUMENTS

| | | |
|---|---|---|
| WO | 2021145953 | 7/2021 |

OTHER PUBLICATIONS

Ribic, Anthony Joseph; Issue Notification for U.S. Appl. No. 16/746,468, filed Jan. 17, 2020, mailed Jun. 30, 2021, 1 pg.

(Continued)

*Primary Examiner* — Reginald S Tillman, Jr.
(74) *Attorney, Agent, or Firm* — Spencer Fane LLP; Steven J. Laureanti

(57) ABSTRACT

A slide assembly for a firearm can include a slide having a top side, a proximal end, a mounting recess about the top side of the slide, a housing recess about the proximal end of the slide, and a retaining hole intersecting the housing recess; an extractor assembly mounted within the housing recess; and an optic sight positioned at least partially in the mounting recess, the optic sight coupled to the slide by a fastener received by the retaining hole, the fastener extending at least partially through the housing recess.

18 Claims, 17 Drawing Sheets

(56) References Cited

U.S. PATENT DOCUMENTS

| | | | | |
|---|---|---|---|---|
| 2021/0033369 | A1* | 2/2021 | Shawley | F41A 3/66 |
| 2021/0293500 | A1 | 9/2021 | Ribic et al. | |

OTHER PUBLICATIONS

Ribic, Anthony Joseph; Non-Final Office Action for U.S. Appl. No. 16/746,468, filed Jan. 17, 2020, mailed Dec. 30, 2020, 10 pgs.
Ribic, Anthony Joseph; Notice of Allowance for U.S. Appl. No. 16/746,468, filed Jan. 17, 2020, mailed Mar. 30, 2021, 5 pgs.
Ribic, Anthony Joseph; Advisory Action for U.S. Appl. No. 17/339,313, filed Jun. 4, 2021, mailed May 3, 2023, 4 pgs.
Ribic, Anthony Joseph; Final Office Action for U.S. Appl. No. 17/339,313, filed Jun. 4, 2021, mailed Jan. 18, 2023, 9 pgs.
Ribic, Anthony Joseph; Issue Notification for U.S. Appl. No. 17/339,313, filed Jun. 4, 2021, mailed Oct. 4, 2023, 2 pgs.
Ribic, Anthony Joseph; Non-Final Office Action for U.S. Appl. No. 17/339,313, filed Jun. 4, 2021, mailed Jul. 11, 2022, 17 pgs.
Ribic, Anthony Joseph; Notice of Allowance for U.S. Appl. No. 17/339,313, filed Jun. 4, 2021, mailed Jun. 16, 2023, 10 pgs.
Assembly drawing for Heckler & Koch firearm.
Assembly drawing for Smith & Wesson firearm.
Assembly drawing for Walther firearm.
Ribic, Anthony Joseph; International Preliminary Report on Patentability for Application No. PCT/US2020/061234, filed Nov. 19, 2020, mailed Jul. 19, 2022, 7 pages.
Ribic, Anthony Joseph; International Search Report and Written Opinion for Application No. PCT/US2020/061234, filed Nov. 19, 2020, mailed Jun. 25, 2021, 11 pages.
Ribic, Anthony Joseph; Communication pursuant to Article 94(3) EPC for European Application No. 20880387.4, filed Nov. 19, 2020, mailed Mar. 13, 2023, 4 pgs.

* cited by examiner

SLIDE ASSEMBLY FOR A FIREARM

CROSS REFERENCE TO RELATED APPLICATIONS

This application is a continuation of U.S. patent application Ser. No. 17/339,313, filed Jun. 4, 2021, which is a continuation of U.S. patent application Ser. No. 16/746,468, filed Jan. 17, 2020, which issued into U.S. Pat. No. 11,067,348 on Jul. 20, 2021, which are hereby specifically incorporated by reference herein in their entireties.

FIELD OF THE INVENTION

The exemplary embodiments of the subject disclosure relate generally to firearms and, more specifically, to a slide assembly for a firearm.

BACKGROUND OF THE DISCLOSURE

For years, handgun users and manufacturers have experimented with methods of affixing optical sights to handguns, including reflexive or holographic bright dot sights, such as the Trijicon® Ruggedized Miniature Reflex ("RMR") sight. A bright dot sight is particularly advantageous, as it operates to project within a transparent viewfinder a virtual or holographic reticle or "dot" which, when superimposed on a target, tracks the hit trajectory of a fired bullet, regardless of the orientation of a user's eyes with respect to the handgun. In this manner, the bright dot sight permits the user to focus most of his/her attention on the target, rather than on alignment of rear and forward iron sights for aiming the handgun. By reducing the effort required to aim, the bright dot sight also allows the user to more consistently discriminate between threat and non-threat scenarios, reducing potential for misidentification and needless loss of life.

The recoil force generated by a handgun can be substantial, particularly with respect to centerfire handgun calibers used for hunting, defense, and in the line of duty. In the case of semi-automatic handguns, forces created by the abrupt rearward movement of the slide upon firing, followed by a subsequent forward movement and closure of the slide under spring force, are particularly damaging to mounting systems of early sights. Large and sturdy mounting systems were developed previously to address these issues, but they added undesirable bulk and weight that rendered them impractical for tactical and law enforcement use. The necessity for large mounting systems decreased only after advances in ruggedization and miniaturization of optic sights enabled them to better withstand the recoil forces of a violently reciprocating handgun slide.

As many semi-automatic handgun designs on the market today predate the miniaturization and ruggedization of optic sights, a handgun slide often requires substantial after-market modifications to accommodate today's advanced sights. Such modifications typically include milling a recess into the slide for receiving the sight and one or more threaded retaining holes into the bottom surface of the recess to receive threaded fasteners for affixing the sight to the slide. The recess is milled as deep as possible to streamline and lower the sight with respect to the slide to permit a conventional iron sight mounted to the front of the slide to be viewable through a transparent viewfinder of the sight, thereby permitting a user to aim the handgun in the event of sight malfunction.

Unfortunately, it is oftentimes difficult to mill the recess as deep as desired without interfering with internal working components of the slide, such as, for example, an extractor assembly of a Glock® handgun positioned within the slide. Further constraints on recess depth are dictated by the length of the threaded fasteners used to mount sights, as these fasteners also cannot extend too far into the slide so as to interfere with internal working components. Even when the recess is milled shallow enough to avoid these issues, milling too much material from the slide reduces grip between the fasteners and the slide, thereby increasing the chance of fastener breakage resulting from shearing forces created when the slide reciprocates.

Some manufacturers have addressed these issues at least partially by milling one or more bosses into the slide that extend vertically from the bottom surface of the recess and into mounting holes within the sight. In this way, the bosses provide additional stability and material for withstanding damaging shearing forces. However, since mounting holes of different sights are sized and positioned differently, bosses may be milled into a slide to accommodate only one type/brand of sight having a particular pattern of mounting holes. This necessarily requires gun manufacturers and after-market gunsmiths to design numerous different milling specifications to accommodate numerous different gun/sight combinations. It also limits the ability to interchange sights, for example, when bosses milled into a handgun slide are not compatible with a desired sight.

Other manufactures have attempted to address these issues with an intermediate mounting plate positioned between the recess of the slide and the sight. Such a mounting plate features appropriately sized and located mounting holes for affixing multiple types/brands of sights. While intermediate mounting plates allow for modularity, they limit the depth at which sights can be positioned relative to handgun slides. By adding an additional component, intermediate plates also increase the probability of forming failure points within sight mounting systems.

There is thus a need for a gun slide assembly and method of modifying a gun slide assembly that addresses these and other disadvantages.

BRIEF SUMMARY OF THE DISCLOSURE

Various embodiments of the subject disclosure position (or adjust the position of) various internal components of the slide in order to reduce or eliminate interference between these components and fasteners used to affix a sight to the slide. In this manner, various embodiments of the subject disclosure permit formation of a deep recess within the slide for receiving the sight without need for bosses or other reinforcing structures. Various other embodiments provide the recess with multiple threaded hole patterns for accommodating multiple different types/brands of sights.

In accordance with one embodiment of the subject disclosure, a slide assembly for a firearm is provided. The slide assembly includes a slide having a top side, a proximal end, a mounting recess about the top side of the slide, and a housing recess about the proximal end of the slide; and an extractor assembly mounted within the housing recess, the extractor assembly including a distal end for engaging a cartridge and a proximal end terminating at a position adjacent about a mid-portion of the mounting recess.

In accordance with another embodiment of the subject disclosure, the proximal end of the extractor assembly terminates at a position distally of the mid-portion of the mounting recess.

In accordance with still another embodiment of the subject disclosure, the extractor assembly includes an extractor for engaging a cartridge; a plunger extending proximally from the extractor; a biasing member biasing the plunger distally against the extractor; a bearing providing a backstop for the biasing member and limiting movement of the plunger with respect to the biasing member; and a stop limiting movement of the bearing.

In accordance with yet another embodiment of the subject disclosure, the slide further includes a stopper bore, the stop of the extractor being positioned within the stopper bore.

In accordance with still another embodiment of the subject disclosure, the slide further includes a tooling slot on a bottom surface of the mounting recess, the tooling slot providing access to the biasing member of the extractor assembly.

In accordance with yet another embodiment of the subject disclosure, the slide further includes a stop removal bore in communication with the stopper bore, the stop removal bore sized to receive a pin for pushing the stop of the extractor assembly out of the stopper bore of the slide.

In accordance with still another embodiment of the subject disclosure, the slide assembly further includes an optic sight mounted within the mounting recess.

In accordance with yet another embodiment of the subject disclosure, the mounting recess of the slide further includes at least one retaining hole, the slide assembly further comprising at least one fastener extending through the optic sight and into the retaining hole to mount the optic sight within the mounting recess.

In accordance with still another embodiment of the subject disclosure, the slide assembly further includes at least one spacer positioned within the mounting recess adjacent the optic sight.

In accordance with yet another embodiment of the subject disclosure, the mounting recess of the slide is provided with multiple patterns of retaining holes to permit mounting of multiple types of optic sights.

In accordance with still another embodiment of the subject disclosure, a method of modifying an original slide assembly of a firearm is provided, the original slide assembly including a slide and an extractor assembly within a housing recess of the slide, the method including removing the extractor assembly from the slide; forming a mounting recess within a top side of the slide; and installing a new extractor assembly into the housing recess of the slide, the extractor assembly including a distal end for engaging a cartridge and a proximal end terminating at a position adjacent about a mid-portion of the mounting recess.

In accordance with yet another embodiment of the subject disclosure, the extractor assembly includes an extractor for engaging a cartridge, a plunger extending proximally from the extractor, a biasing member biasing the plunger distally against the extractor, a bearing providing a backstop for the biasing member and limiting movement of the plunger with respect to the biasing member, and a stop limiting movement of the bearing, the method of modifying an original slide assembly further including forming a stopper bore into the slide for receiving the stop of the extractor assembly.

In accordance with still another embodiment of the subject disclosure, the method of modifying an original slide assembly further includes forming a tooling slot into a bottom surface of the mounting recess, the tooling slot providing access to the biasing member of the extractor assembly.

In accordance with yet another embodiment of the subject disclosure, the method of modifying an original slide assembly further includes forming a stop removal bore into the slide in communication with the stopper bore, the stop removal bore sized to receive a pin for pushing the stop of the extractor assembly out of the stopper bore of the slide.

In accordance with still another embodiment of the subject disclosure, the method of modifying an original slide assembly further includes forming at least one retaining hole into a bottom surface of the mounting recess of the slide to facilitate mounting of an optic sight.

In accordance with yet another embodiment of the subject disclosure, the at least one retaining hole is formed proximally of the proximal end of the extractor assembly.

In accordance with still another embodiment of the subject disclosure, the at least one retaining hole includes multiple patterns of retaining holes to accommodate multiple types of optic sights.

BRIEF DESCRIPTION OF THE SEVERAL VIEWS OF THE DRAWINGS

The foregoing summary, as well as the following detailed description of the exemplary embodiments of the subject disclosure, will be better understood when read in conjunction with the appended drawings. For the purpose of illustrating the present disclosure, there are shown in the drawings exemplary embodiments. It should be understood, however, that the subject application is not limited to the precise arrangements and instrumentalities shown.

DETAILED DESCRIPTION OF THE DISCLOSURE

Figure 1A:
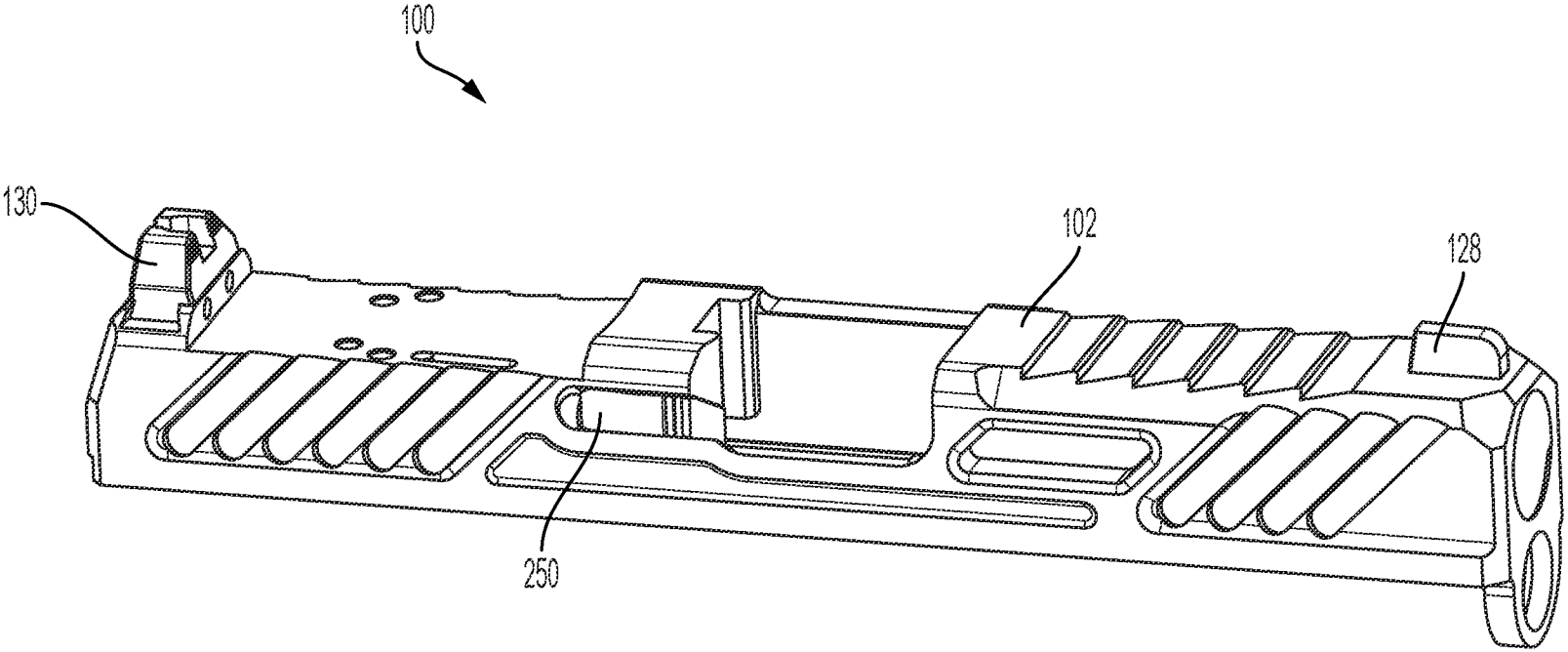
FIG. 1*a* is a perspective view of a slide assembly for a firearm in accordance with an exemplary embodiment of the subject disclosure.

Reference will now be made in detail to the various exemplary embodiments of the subject disclosure illustrated in the accompanying drawings. Wherever possible, the same or like reference numbers will be used throughout the drawings to refer to the same or like features. It should be noted that the drawings are in simplified form and are not drawn to precise scale. Certain terminology is used in the following description for convenience only and is not limiting. Directional terms such as top, bottom, left, right, above, below and diagonal, are used with respect to the accompanying drawings. The term "distal" shall mean away from the center of a body. The term "proximal" shall mean closer towards the center of a body and/or away from the "distal" end. The words "inwardly" and "outwardly" refer to directions toward and away from, respectively, the geometric center of the identified element and designated parts thereof. Such directional terms used in conjunction with the following description of the drawings should not be construed to limit the scope of the subject application in any manner not explicitly set forth. Additionally, the term "a," as used in the specification, means "at least one." The terminology includes the words above specifically mentioned, derivatives thereof, and words of similar import.

"About" as used herein when referring to a measurable value such as an amount, a temporal duration, and the like, is meant to encompass variations of ±2.0%, ±10%, ±5%, ±1%, or ±0.1% from the specified value, as such variations are appropriate.

"Substantially" as used herein shall mean considerable in extent, largely but not wholly that which is specified, or an appropriate variation therefrom as is acceptable within the field of art.

Throughout the subject application, various aspects thereof can be presented in a range format. It should be understood that the description in range format is merely for convenience and brevity and should not be construed as an inflexible limitation on the scope of the subject disclosure. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6, etc., as well as individual numbers within that range, for example, 1, 2, 2.7, 3, 4, 5, 5.3, and 6. This applies regardless of the breadth of the range.

Furthermore, the described features, advantages and characteristics of the exemplary embodiments of the subject disclosure may be combined in any suitable manner in one or more embodiments. One skilled in the relevant art will recognize, in light of the description herein, that the subject disclosure can be practiced without one or more of the specific features or advantages of a particular exemplary embodiment. In other instances, additional features and advantages may be recognized in certain embodiments that may not be present in all exemplary embodiments of the present disclosure.

Figure 1B:
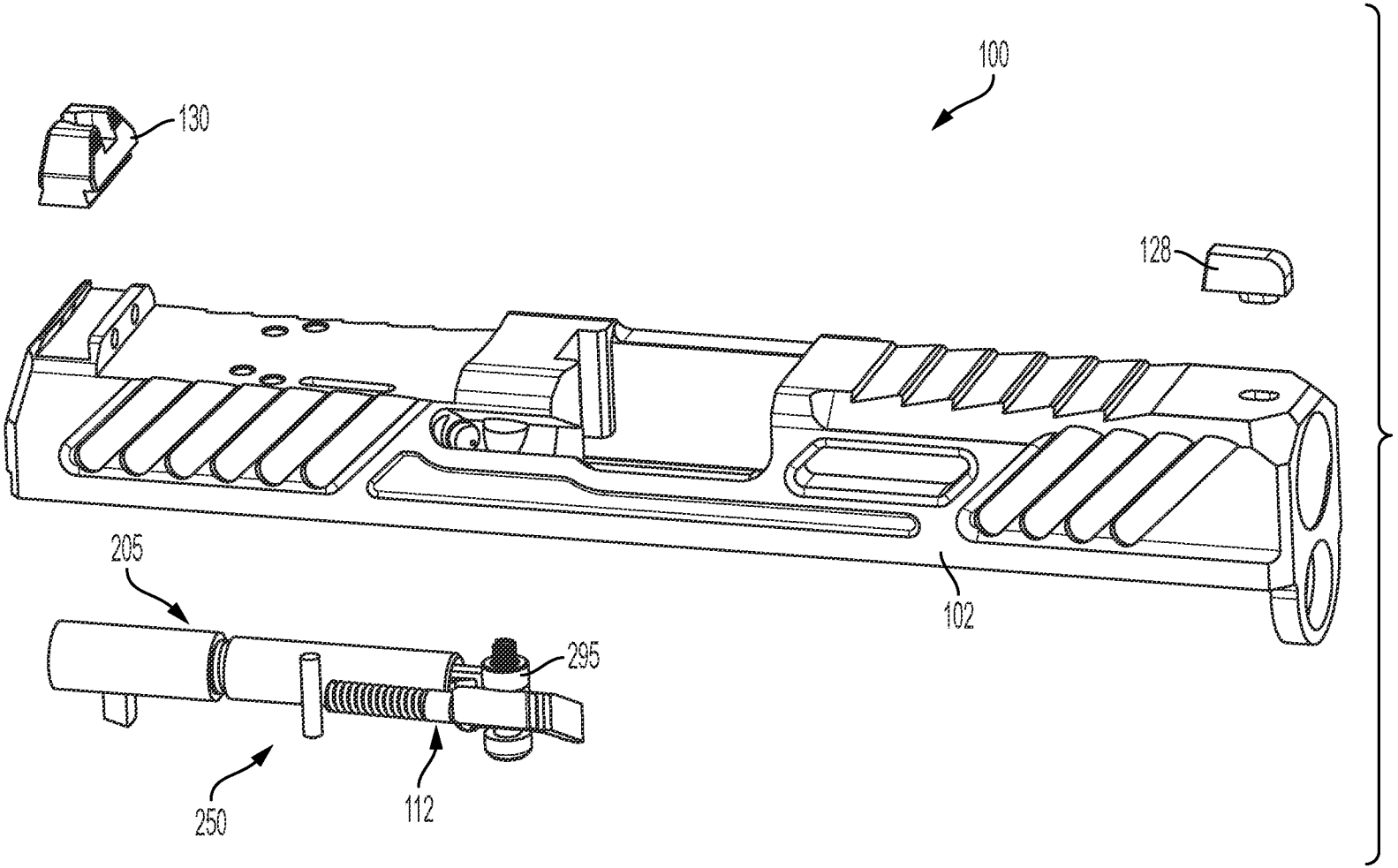
FIG. 1*b* is an exploded perspective view of the slide assembly of FIG. 1*a;*

Referring now to FIGS. 1*a* and 1*b*, there is seen perspective and exploded views, respectively, of a slide assembly 100 for a firearm (such as, for example, a handgun), in accordance with an exemplary embodiment of the subject disclosure. Slide assembly 100 includes a slide 102, front and rear iron sights 128, 130 for permitting a user to aim the firearm in a conventional fashion, and slide components 250 positioned within slide 102, including firing assembly 205, extractor assembly 112 and firing pin safety 295. Slide assembly 100 is configured to be coupled to a firearm frame having other components (not shown) for forming a completed firearm.

Figure 2A:
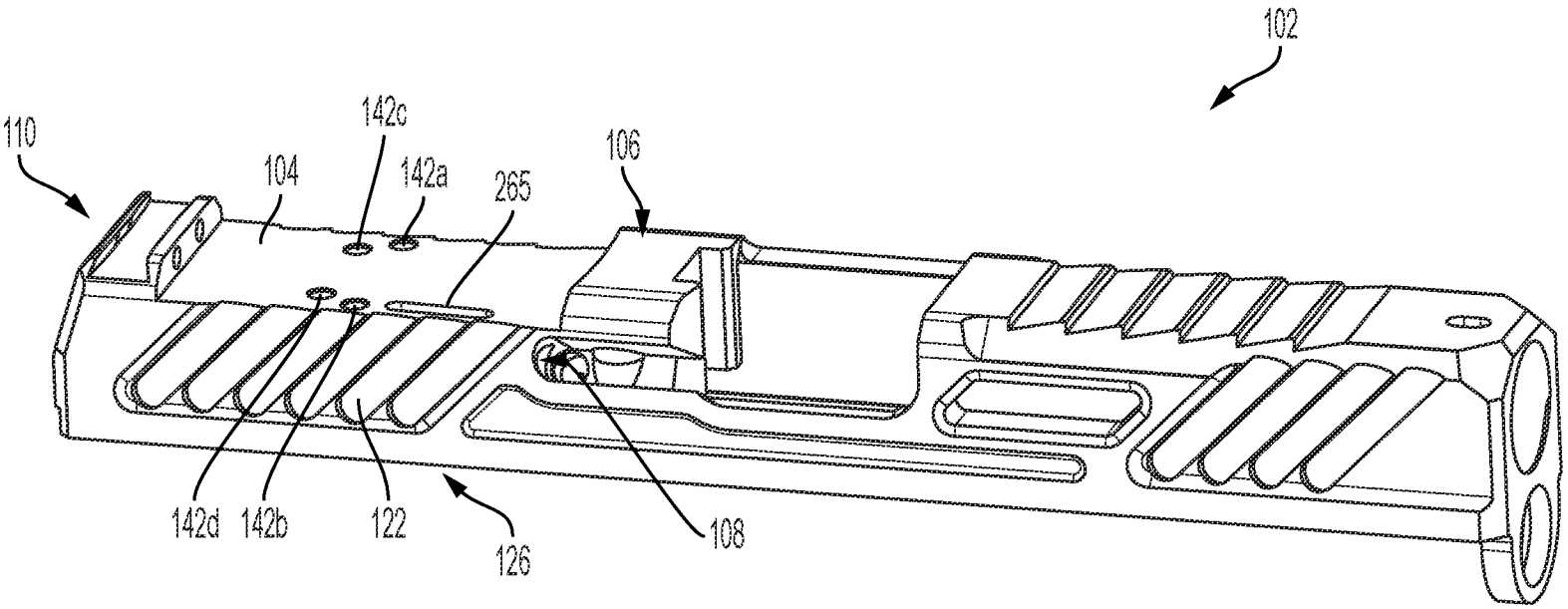
FIG. 2*a* is a perspective view of a slide in accordance with an exemplary embodiment of the subject disclosure.
Figure 2B:
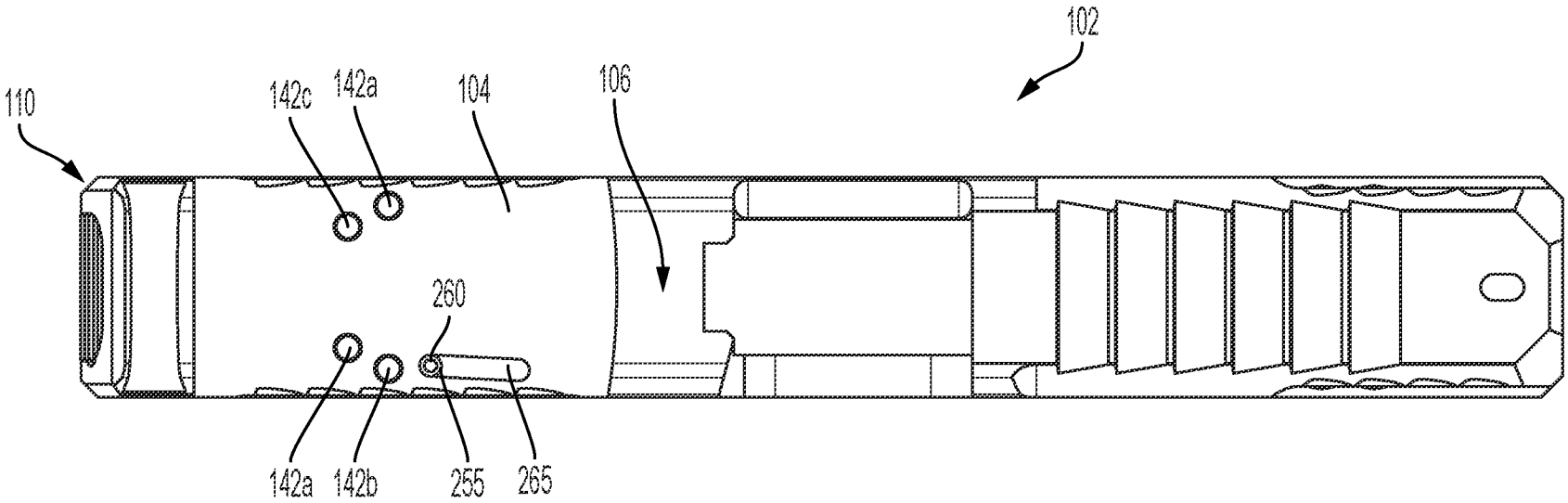
FIG. 2*b* is a top view of the slide of FIG. 2*a;*
Figure 2C:
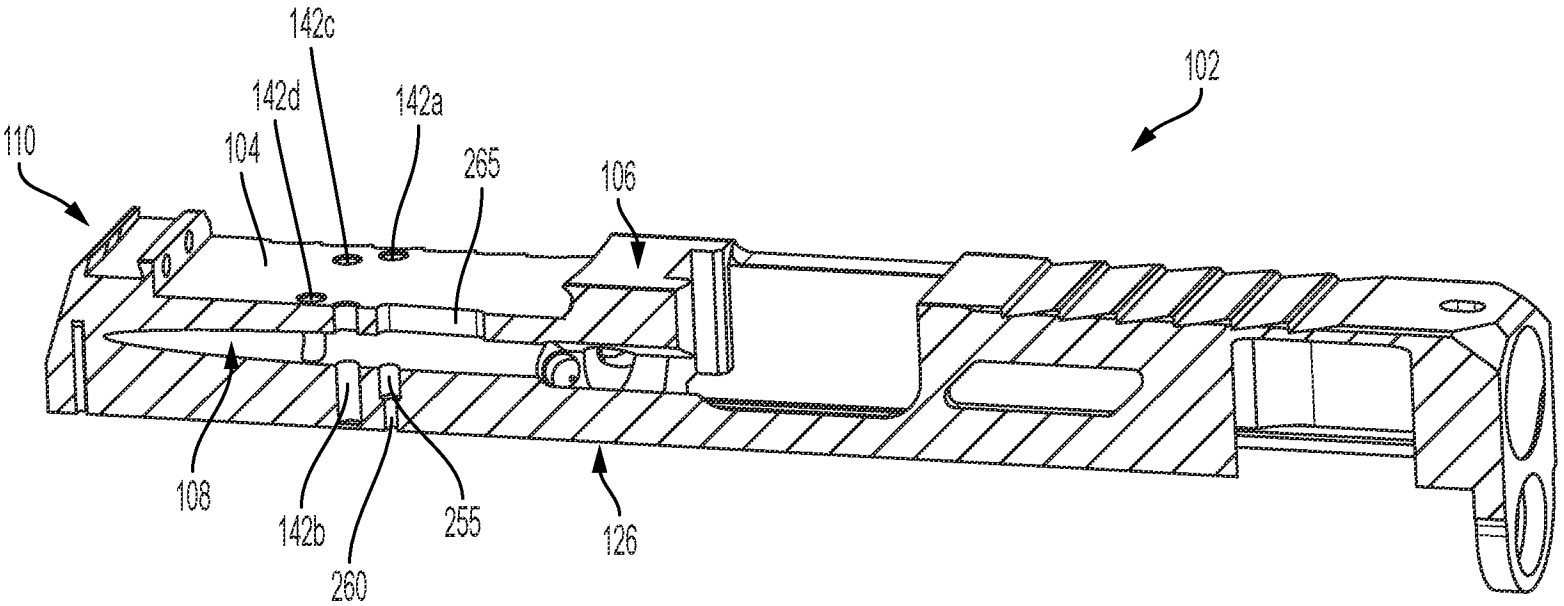
FIG. 2*c* is a cross-sectional view of the slide of FIG. 2*a;*

Referring now to FIGS. 2*a* through 2*c*, there is seen various views of a slide 102 in accordance with an exemplary embodiment of the subject disclosure. Slide 102 includes a bottom side 126, a top side 106 provided at a proximal end 110 with a mounting recess 104 having one or more retaining holes 142 (a through d) for receiving an optic sight (as more fully described below) and a housing recess 108 positioned below the bottom surface of mounting recess 104 for receiving slide components 250. Slide 102 also includes a blind stopper bore 255 extending into a lateral side 122 from mounting recess 104, a stop removal bore 260 extending from a bottom of blind stopper bore 255 to bottom side 126 of slide 102, and a tooling slot 265 extending from a top of blind stopper bore 255 along the bottom surface of mounting recess 104.

As illustrated, mounting recess 104 is formed on slide 102 as a substantially rectangular recess, although it may assume other shapes including, for example and without limitation, substantially square, oval, polygonal, and/or circular shapes. In some embodiments, mounting recess 104 may be dispensed with entirely, in which case an optic sight may be mounted directly to a planar portion of top side 106 of slide 102 adjacent its proximal end 110.

Figure 3A:
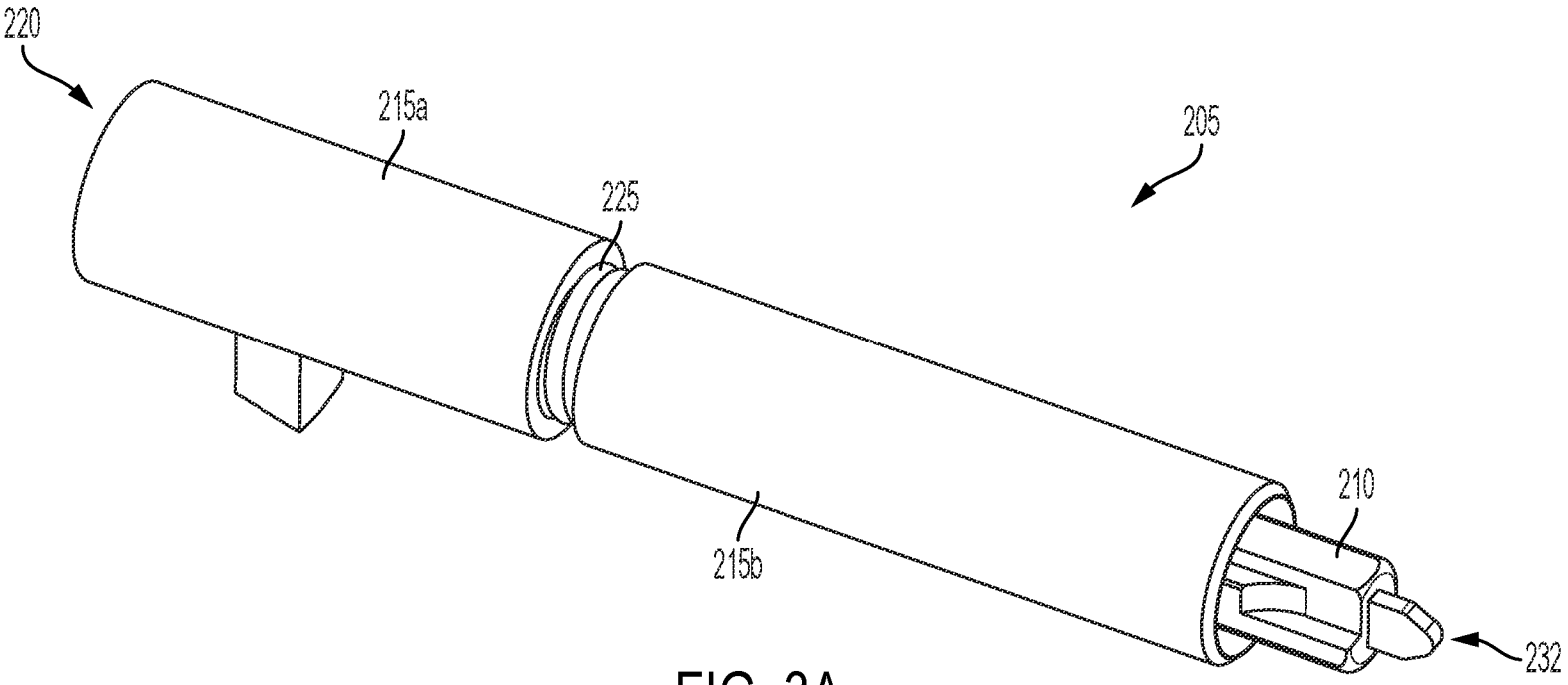
FIG. 3*a* is a perspective view of a firing assembly in accordance with an exemplary embodiment of the subject disclosure.
Figure 3B:
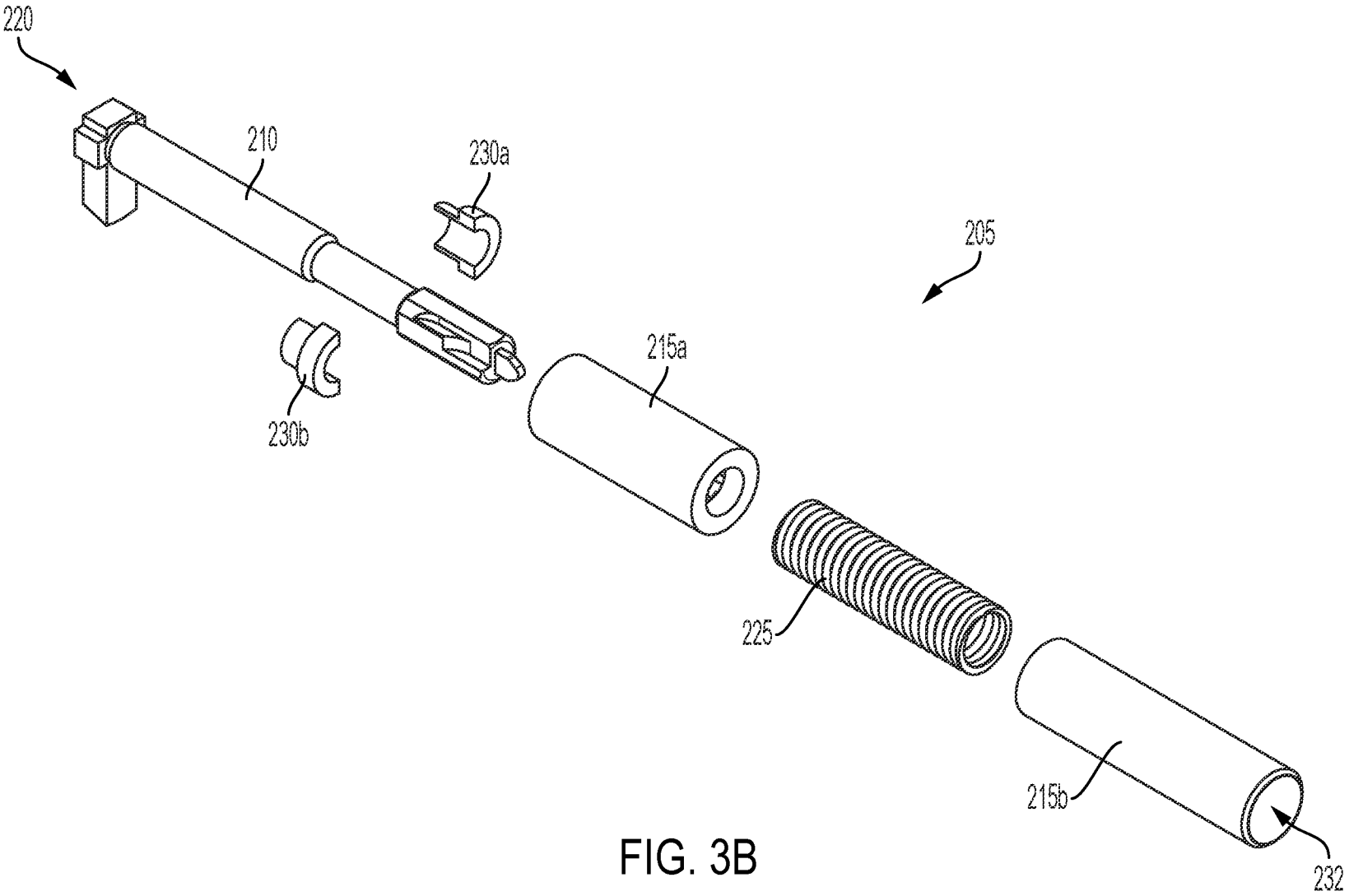
FIG. 3*b* is an exploded perspective view of the firing assembly of FIG. 3*a;*

Referring now to FIGS. 3*a* and 3*b*, there is seen perspective and exploded views, respectively, of a firing assembly 205 in accordance with an exemplary embodiment of the subject disclosure. Firing assembly 205 includes a firing pin 210 at a proximal end 220 slidably positioned within spacer sleeves 215*a*, 215*b* and biased forwardly toward a distal end 232 of firing assembly 205 by pin spring 225 acting on spacer sleeve 215*a*. Firing assembly 205 also includes spring cups 230*a*, 230*b* attached to firing pin 210 to provide a backstop for pin spring 225.

Figure 4A:
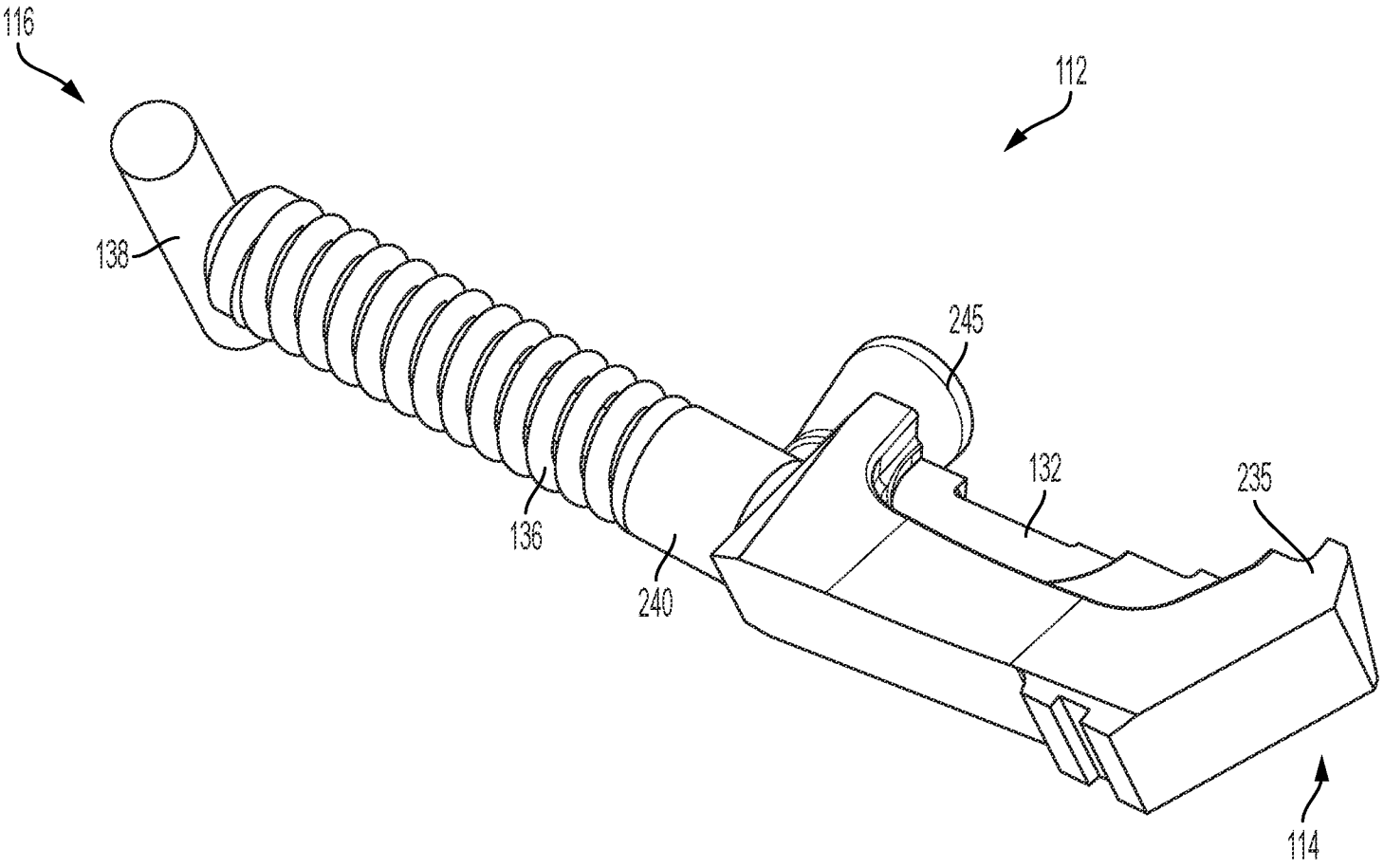
FIG. 4*a* is a perspective view of an extractor assembly in accordance with an exemplary embodiment of the subject disclosure.
Figure 4B:
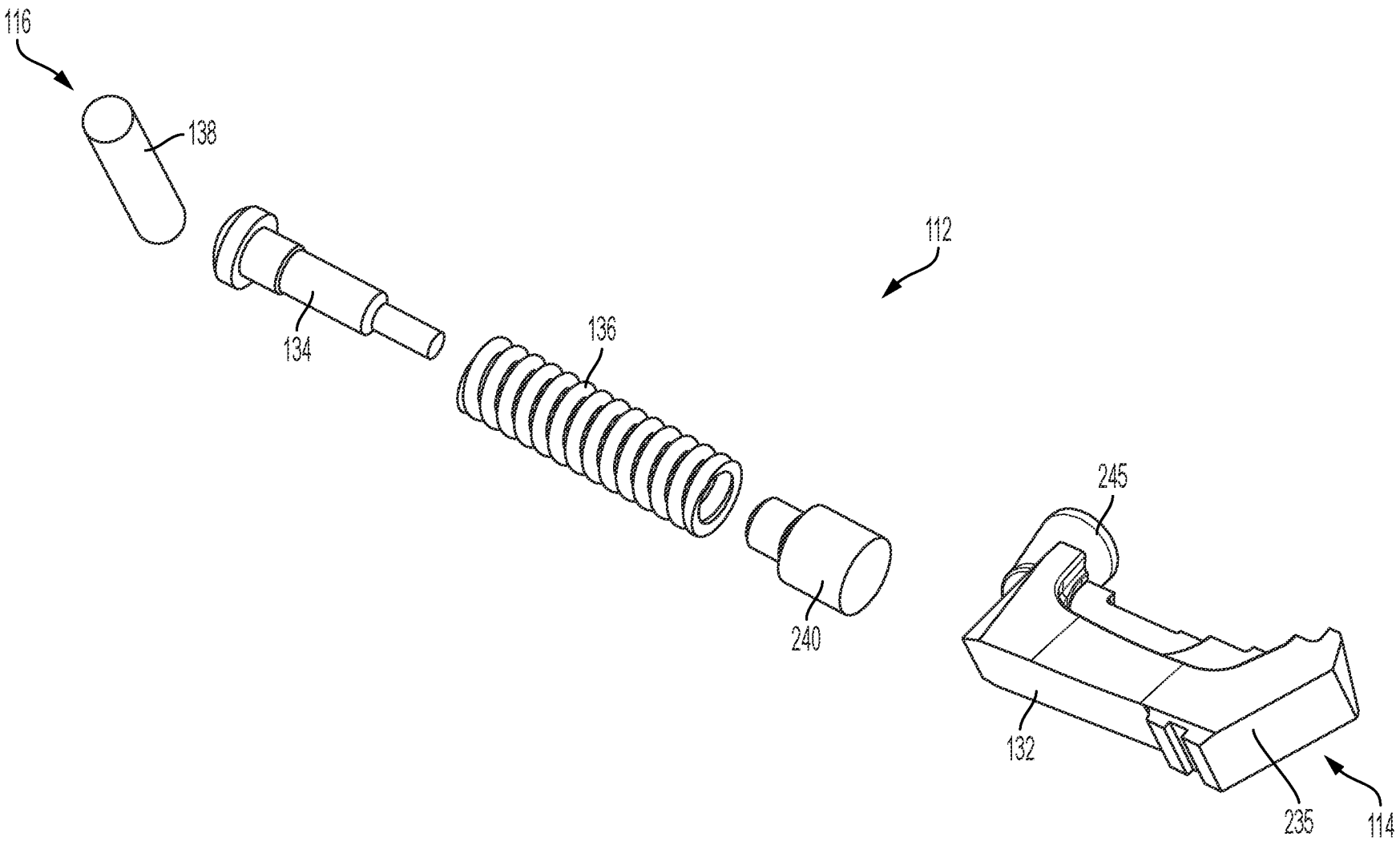
FIG. 4*b* is an exploded perspective view of the extractor assembly of FIG. 4*a;*
Figure 5A:
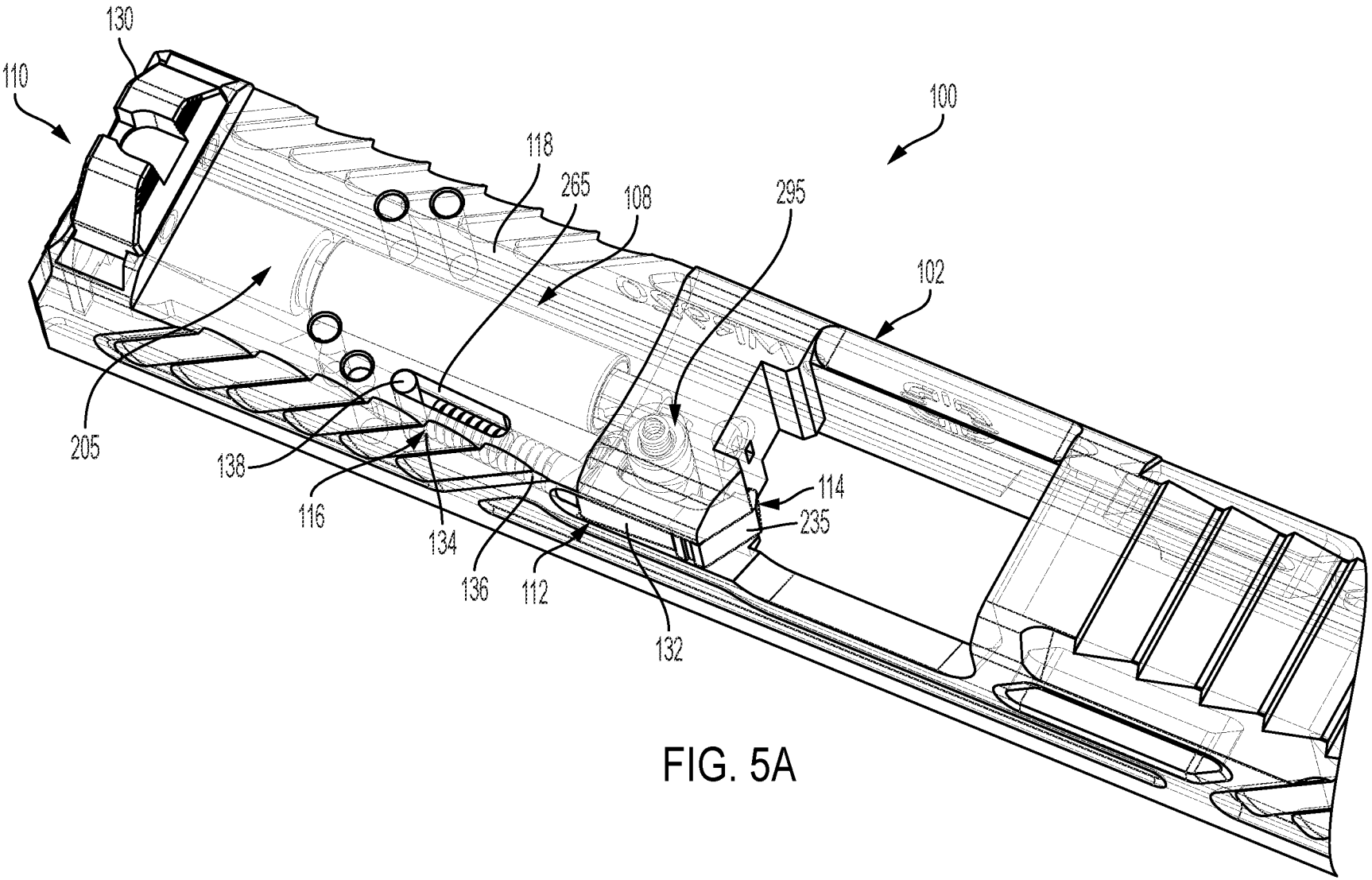
FIG. 5*a* is a transparent perspective view of the slide assembly of FIG. 1*a;*
Figure 5B:
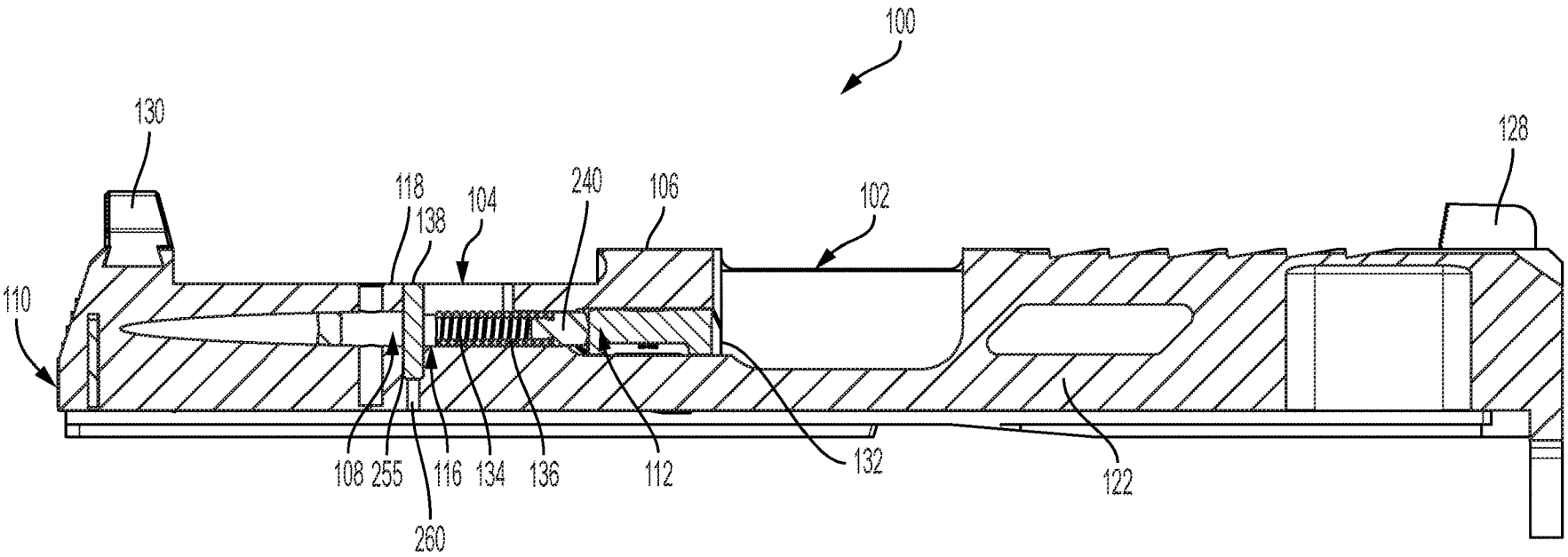
FIG. 5*b* is a cross-sectional view of the slide assembly of FIG. 1*a;*

Referring now to FIGS. 4*a* and 4*b*, there is seen perspective and exploded views, respectively, of an extractor assembly 112 in accordance with an exemplary embodiment of the subject disclosure. Extractor assembly 112 includes proximal and distal ends 116, 114, an extractor 132 with a gripping end 235 mounted pivotally about a pivot end 245 within slide 102, a biasing member 136 (e.g., a spring) for urging a plunger 240 against extractor 132, a bearing 134 for providing a backstop for biasing member 136 and for limiting movement of plunger 240 against biasing member and toward proximal end 116 of extractor assembly 112, and a stop 138 for limiting movement of bearing 134 toward proximal end 110 of slide 102. As shown best shown in FIGS. 5*a* and 5*b*, stop 138 is positioned entirely within stopper bore 255 of slide 102 approximately about a mid-portion 118 of mounting recess 104 such that an entirety of extractor assembly 112 is positioned within housing recess 108 below the front of mounting recess 104 (or further forward in some embodiments), thereby leaving at least a rear region of housing recess 108 clear of any components of extractor assembly 112. It should be appreciated that, although the Figures show stopper bore 255 in a vertical orientation about the mid-point of mounting recess 104, stopper bore 255 may be placed in other orientations (e.g., horizontal, at an angle, etc.) or at other positions relative to mounting recess 104. It should also be appreciated that stop 138 may be formed with screw threads or other features without departing from the spirit of the invention, and that various embodiments of the subject disclosure are not intended to be limited to specific structures used to form stop 138.

To position extractor assembly 112 within slide 102, extractor assembly 112 (without stop 138) is first properly positioned within housing recess 108. A user then inserts a tool (not shown) within tooling slot 265 to withdraw biasing member 136 and bearing 134 distally toward extractor 132. Stop 138 is then inserted fully within stopper bore 255 downwardly from the bottom of mounting recess 104, after which the tool is removed. Removal of the tool causes biasing member 136 to bias bearing 134 against the side of stop 138 and, in this manner, maintain stop 138 within stopper bore 255 via friction. Stop 138 is prevented from escaping upwardly via an installed optic sight (see below) or, alternatively, via a cover plate (not shown), which may be installed within mounting recess 104 of slide 102 in the event an optic sight is not installed.

To remove extractor assembly 112 from slide 102, the user first removes the optic sight (or cover plate), after which he/she employs the tool to withdraw biasing member 136 again while simultaneously inserting a pin (not shown) into stop removal bore 260 from bottom side 126 of slide 102. This causes stop 138 to travel upwardly above the bottom surface of mounting recess 104, where it can be removed by hand. Once stop 138 is removed, the tool may be extracted and the remaining portions of extractor assembly 112 removed from housing recess 108 in a conventional manner.

As described above, tooling slot 265 and stop removal bore 260 are provided to facilitate installation and removal of extractor assembly 112 from slide 102. It should be appreciated, however, that one or both of tooling slot 265 and stop removal bore 260 may be omitted, and that various embodiments of the subject disclosure are not intended to require either one. It should also be appreciated that various embodiments of the subject disclosure are not intended to require any structures for facilitating or assisting with installation and removal of extractor assembly 112 from slide 102.

Firing assembly 205 and extractor assembly 112 operate together to fire a bullet and extract a spent cartridge casing from a barrel (not shown) of the firearm. Prior to firing, a live cartridge (with a bullet) is positioned within the barrel such that gripping end 235 of extractor 132 engages a rim of the cartridge casing. When acted upon by a trigger assembly (not shown), firing pin 210 of firing assembly 205 is urged rapidly toward distal end 230 of firing assembly 205 to strike the cartridge, thereby causing the bullet of the cartridge to be fired through the barrel of the firearm. Rearward force created by rapid expansion of propellant gasses from the bullet casing causes slide 102 and its components to recoil rapidly away from the barrel, thereby causing extractor 132 to extract the spent cartridge casing from the barrel. After the extracted cartridge casing is ejected from the firearm, slide 102 reciprocates rapidly toward its original position under spring pressure to urge a new, live cartridge into the barrel. The force of the reciprocating movement of slide 102 causes gripping end 235 of extractor 132 to engage the rim of the new cartridge casing, thereby causing extractor 132 to pivot about pivot end 245 toward plunger 240. This, in turn, causes gripping end 235 of extractor 132 to clear and pass forward of the rim, after which plunger 240, under force of biasing member 136, pivots extractor 132 into its original position for engaging gripping end 235 with the rim of the new cartridge casing. The firearm may then be operated to fire a bullet from the new cartridge.

Figure 6A:
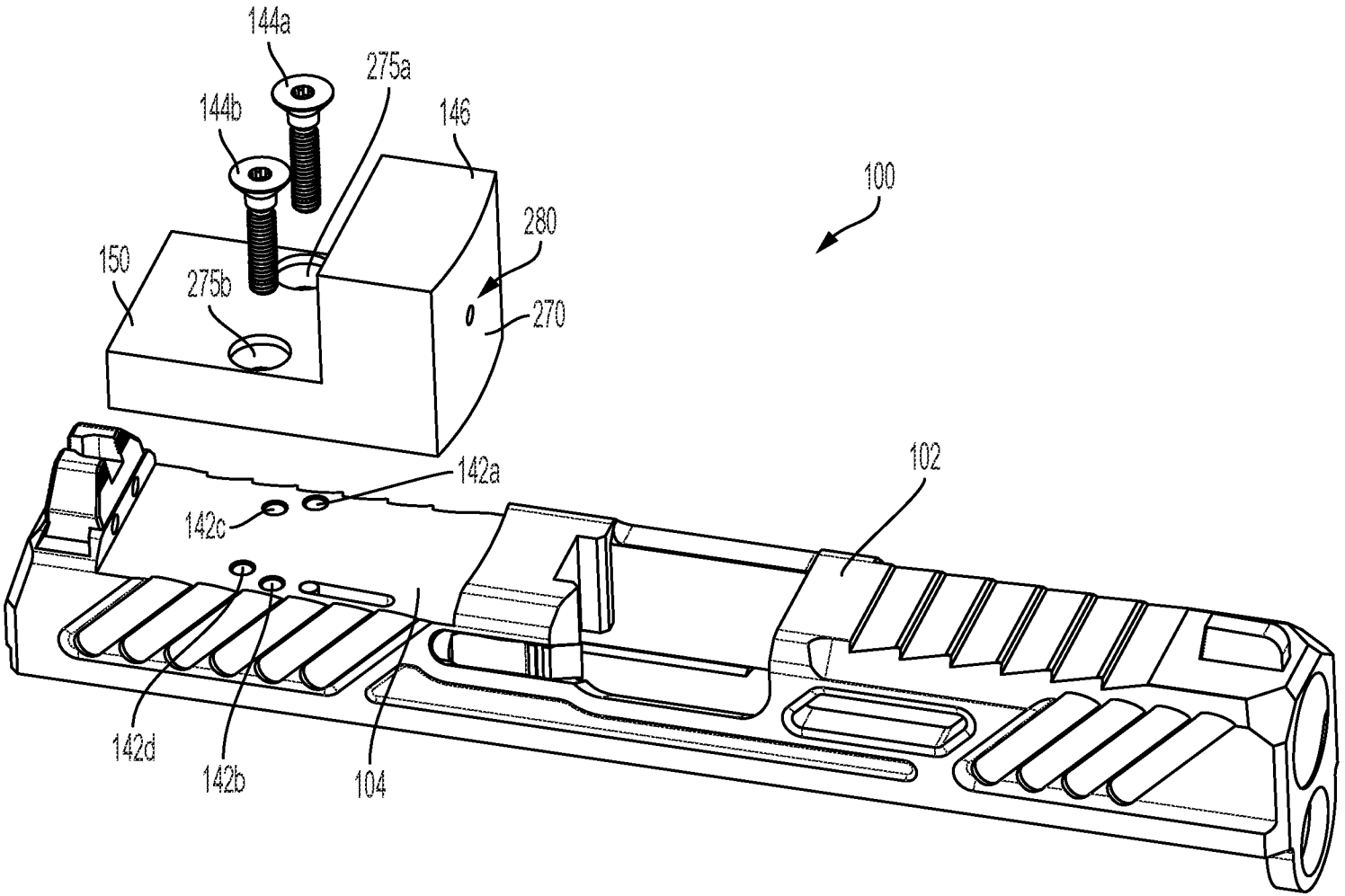
FIG. 6*a* is an exploded perspective view of the slide assembly of FIG. 1*a* with an installed optic sight in accordance with an exemplary embodiment of the subject disclosure.
Figure 6B:
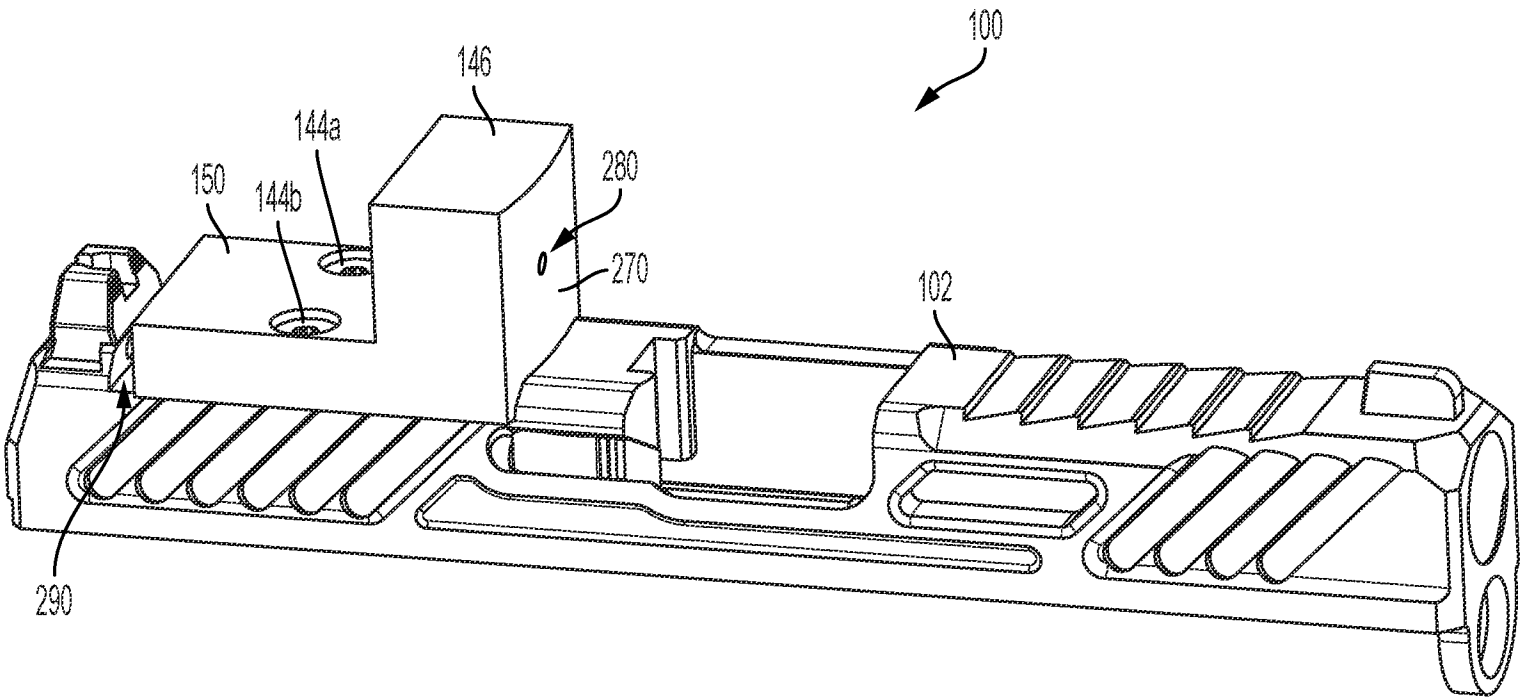
FIG. 6*b* is a perspective view of the slide assembly of FIG. 1*a* with an installed optic sight in accordance with an exemplary embodiment of the subject disclosure.
Figure 6C:
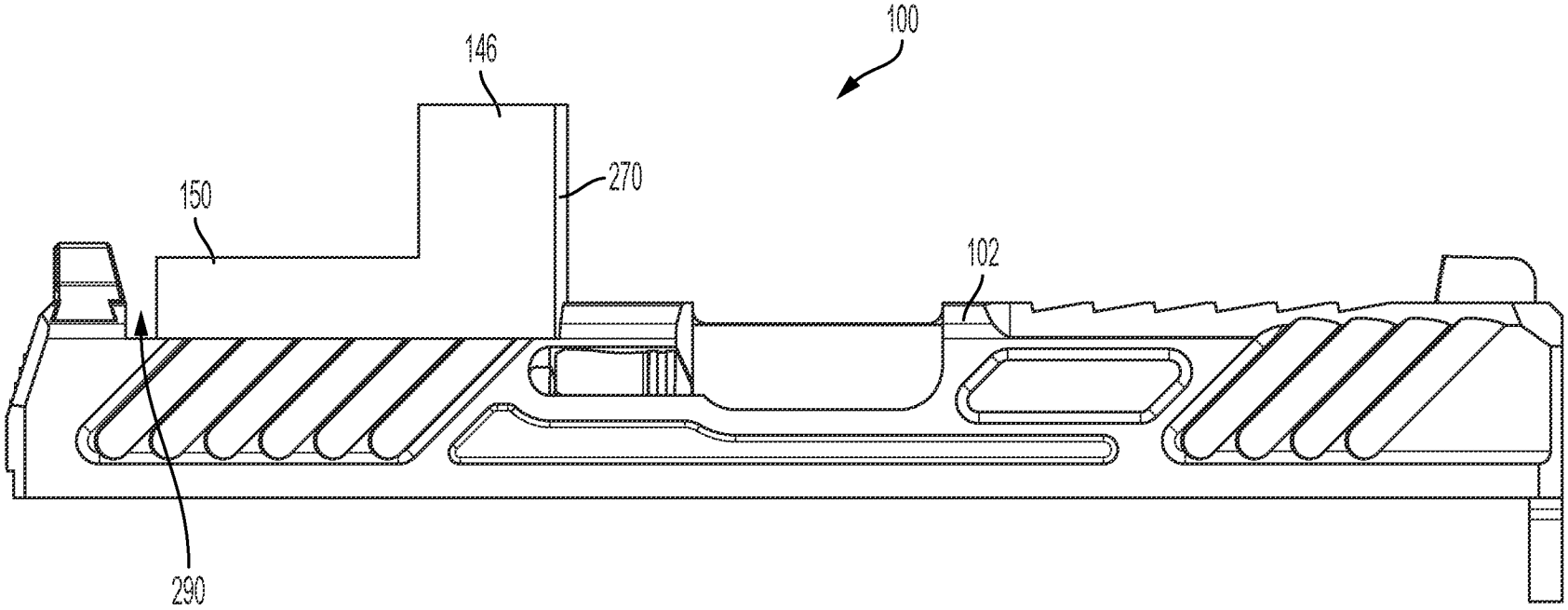
FIG. 6*c* is a side view of the slide assembly of FIG. 1*a* with an installed optic sight in accordance with an exemplary embodiment of the subject disclosure.

Referring now to FIGS. 6*a* through 6*c*, there is seen various views of slide assembly 100 with an installed optic sight 146 in accordance with an exemplary embodiment of the subject disclosure. Optic sight 146 includes a viewfinder 270 operable to project a reflexive or holographic bright dot 280 and a base plate 150 having two mounting holes 275*a*, 275*b* sized to receive respective fasteners 144*a*, 144*b* for rigidly affixing optic sight 146 to slide 102 via retaining holes 142*a*, 142*b*. In one embodiment, fasteners 144*a*, 144*b* and retaining holes 142*a*, 142*b* are threaded to permit optic sight 146 to be affixed to slide 102 using screw-like fasteners 144*a*, 144*b*. It should be appreciated, however, that other types of fasteners 144*a*, 144*b* and retaining holes 142*a*, 142*b* may be used, and that various embodiments of the subject disclosure are not intended to be limited to any particular structure or mechanism for affixing optic sight 146 to slide 102. It should also be appreciated that, although optic sight 146 is shown affixed to slide 102 using two fasteners 144*a*, 144*b*, any number of fasteners 144 can be employed, depending on the type/brand or design of optic sight 146.

Since extractor assembly 112 is positioned distally of retaining holes 142*a*, 142*b*, fasteners 144*a*, 144*b* can extend deep within slide 102 without interfering with extractor assembly 112 or other slide components 250. In this manner, fasteners 144*a*, 144*b* grip more material of slide 102 to provide a strong and rugged affixing ability without need for bosses and/or other reinforcing structures, though various embodiments of the subject disclosure do not preclude the use of bosses and/or other reinforcing structures. Positioning extractor assembly 112 in this manner also allows mounting recess 104 to be formed deeper into slide 102 to advantageously lower optic sight 146 for better coincidence of iron sights 128, 130 with bright dot 280 of optic sight 146.

Since various embodiments of the subject disclosure dispense with the need for bosses and/or other reinforcing structures, multiple different patterns of retaining holes 142 may be provided on the bottom surface of mounting recess 104 to accommodate multiple different types/brands of optic sights. For example, the embodiments depicted in the Figures illustrate two sets of retaining holes 142 (i.e., retaining holes 142*a*, 142*b* and retaining holes 142*c*, 142*d*) for accommodating two different types/brands of optic sights, including optic sight 146. It should be appreciated, however, that additional patterns of retaining holes 142 may be provided on the bottom surface of mounting recess 104 to expand compatibility of slide assembly 100 with other types/brands of optic sights. These additional patterns of retaining holes 142 may be provided during manufacture of slide 102 to create a "universal" optic sight mount, or alternatively may be formed into slide 102 after-market, for example, by a gunsmith.

Figure 7A:
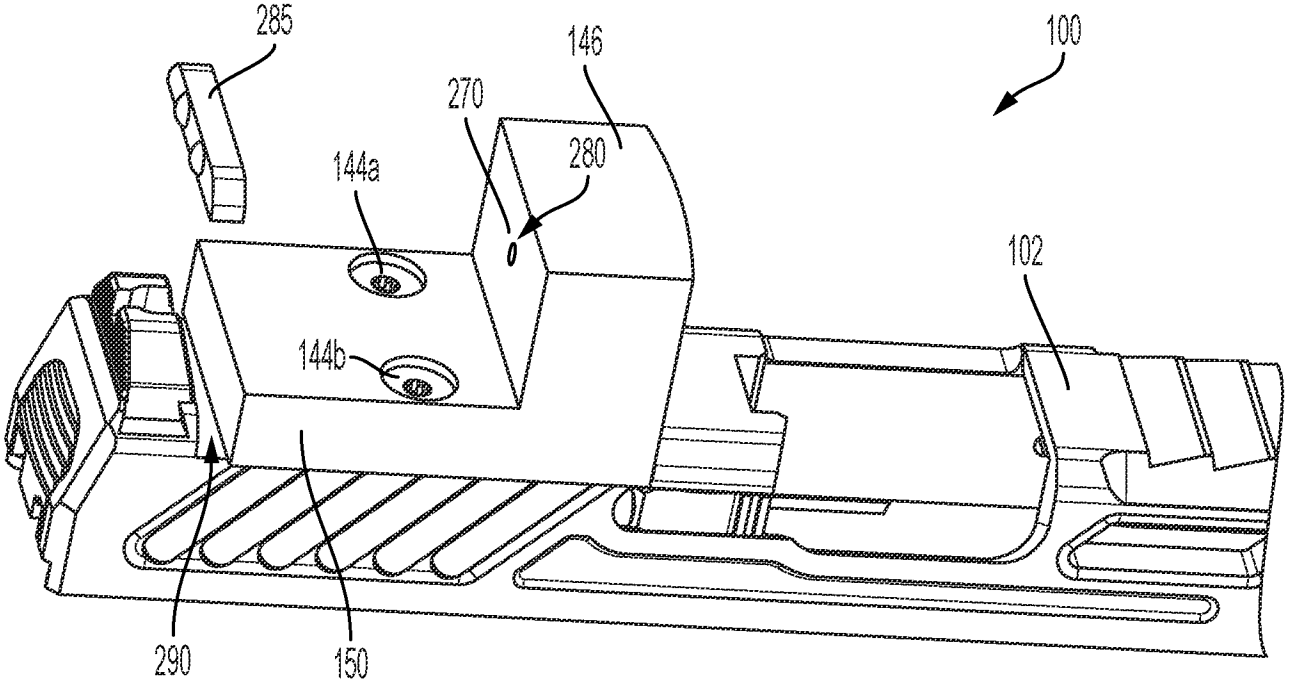
FIG. 7*a* is an exploded perspective view of the slide assembly of FIG. 1*a* with an installed optic sight and keyed spacer in accordance with an exemplary embodiment of the subject disclosure.
Figure 7B:
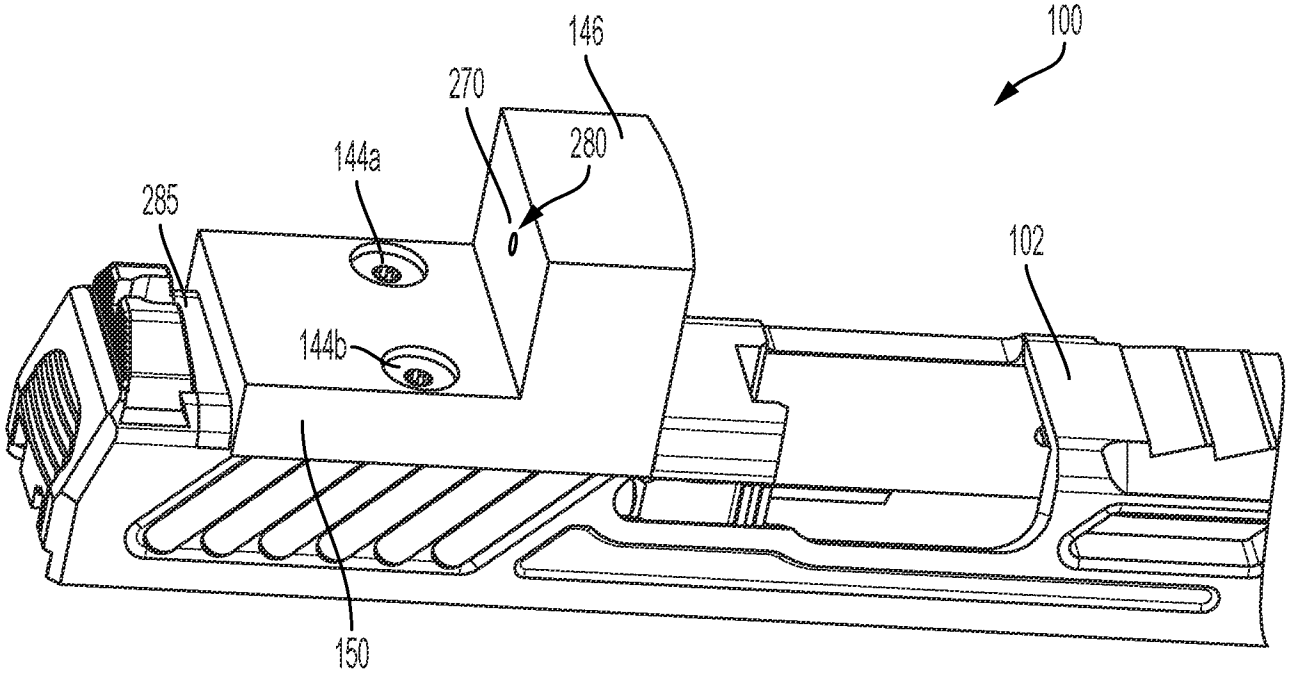
FIG. 7*b* is an exploded perspective view of the slide assembly of FIG. 1*a* with an installed optic sight and keyed spacer in accordance with an exemplary embodiment of the subject disclosure.

To better accommodate different types/brands of optic sights, it may be desirable to form mounting recess 104 long enough longitudinally (i.e., between the proximal and distal ends of mounting recess 104) to accommodate optic sights 146 having different longitudinal lengths and mounting holes at different longitudinal positions. In these embodiments, when affixing an optic sight 146 with a shorter length, a gap 290 will form, for example, between the proximal end of mounting recess 104 and the proximal end of a mounted optic sight (see FIGS. 6*b* and 6*c*). This gap 290 is not only unsightly, but it may also reduce support provided to the optic sight which, in turn, may lead to damage of the sight or sheering of fasteners 144*a*, 144*b* resulting from extreme forces produced by reciprocation of slide 102. To address this, various embodiments of the subject disclosure provide one or more keyed spacers 285 that may be positioned to fill gap 290 and provide additional support for the optic sight 146, for example, support for preventing optic sight 146 from twisting or otherwise moving with respect to slide 102 when installed (see FIGS. 7*a* and 7*b*).

In one embodiment, support is improved by constructing keyed spacers 285 (or a combination of keyed spacers 285) to be slightly larger than gap 290, so that keyed spacers maintain frictional compression with optic sight 146 when installed. To improve frictional grip between keyed spacers 285 and optical sight 146, keyed spacers 285 may be constructed of a rubberlike material (or material having rubber-like qualities) and/or be coated in a rubber-like or similar material, although in other embodiments keyed spacers are constructed from a rigid material, such as, for example, metal or a rigid polymer. Mounting recess 104 may also be provided with texture or be coated with a rubberlike material to prevent movement or twisting of an optic sight. To further prevent twisting, keyed spacers 285 may be provided with lateral arms for cradling the left and right sides of optic sight 146. Keyed spacers 285 may also be provided with one or more cams having coupled screws, whereby tightening of the screws urges the cams against the back of optic sight 146 to further improve the grip between keyed spacers 285 and optic sight 146. Keyed spacers 285 may also be provided with a textured surface to improve grip between keyed spacers 285 and optic sight 146. It should be appreciated that different sizes and numbers of spacers 285 may be provided to accommodate and fill different sized gaps 290. It should also be appreciated that similar spacers 285 may be provided to fill any gaps that may form between the distal end of mounting recess 104 and the distal end of the mounted optic sight, or at any other location within mounting recess 104.

In another embodiment, one or more annual bearings (or compression bushings) are inserted into each mounting hole 275 of optic sight 146. The annual bearings are designed to fit snugly within mounting holes 275 and to slidingly receive fasteners 144 for mounting optic sight 146 to slide 102. The annual bearings provide lateral support within mounting holes 275 to reduce movement and twisting of optic sight 146. Different annual bearings with different dimensions may be designed to accommodate multiple different types/brands or designs of optic sights. In yet another embodiment, in lieu of or in addition to annual bearings, a retaining compound (such as Loctite® retaining compound) is injected into mounting holes 275 immediately prior or contemporaneously to insertion of fasteners 144 for mounting optic sight 146. The retaining compound cures and forms a bond between fasteners 144 and the inside surfaces of mounting holes 275, thereby improving support and minimizing (or eliminating) the chance of movement or twisting of optic sight 146 when mounted on slide 102.

Figure 8:
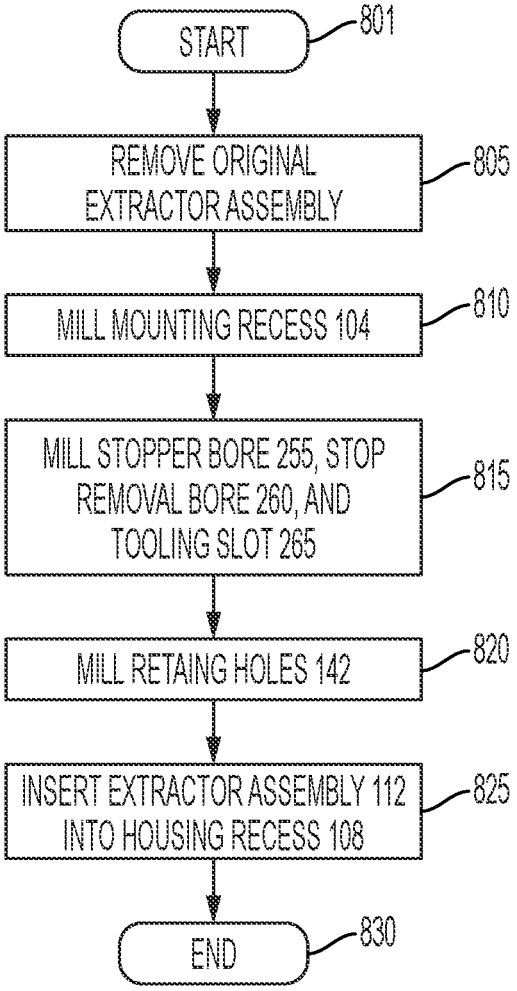
FIG. 8 is a process flow diagram showing steps for installation of an extractor assembly, in accordance with an exemplary embodiment of the subject disclosure.

Referring now to FIG. 8, there is seen a flow diagram 800 depicting a process for modifying an original slide assembly of a handgun, such as a Glock® handgun, to produce slide assembly 100, in accordance with an exemplary embodiment of the subject disclosure. The process begins at step 801 and proceeds to step 805. At this step, an original extractor assembly (not shown) is removed from housing recess 108 of the original slide. Extractor assemblies of Glock® handguns, for example, include lengthened bearings that typically extend from the biasing member all the way to the slide's proximal back end, which acts as a support for the extractor assembly. The process then proceeds to step 810, at which mounting recess 104 is formed into top side 106 of the original slide for receiving an optic sight. At step 815, stopper 255, stop removal bore 260 and tooling slot 265 are formed into the original slide. Retaining holes, such as, for example, retaining holes 142*a*, 142*b*, 142*c*, 142*d*, are then formed into the slide at step 820, after which the process proceeds to step 825. At this step, extractor assembly 112 is inserted into housing recess 108 (see insertion procedure described above) to produce slide assembly 100. The process then ends at step 830.

It will be appreciated by those skilled in the art that changes could be made to the exemplary embodiments described above without departing from the broad inventive concept thereof. It is to be understood, therefore, that this disclosure is not limited to the particular embodiments disclosed, but it is intended to cover modifications within the spirit and scope of the subject disclosure as defined by the appended claims.

That which is claimed is:

1. A slide assembly for a firearm comprising:

a slide having a top side, a proximal end, a mounting recess about the top side of the slide, a housing recess about the proximal end of the slide, and a retaining hole intersecting the housing recess;

an extractor assembly mounted within the housing recess; and an optic sight positioned at least partially in the mounting recess, the optic sight coupled to the slide by a fastener received by the retaining hole, the fastener extending at least partially through the housing recess.

2. The slide assembly of claim 1, wherein the retaining hole terminates at about a bottom side of the slide.

3. The slide assembly of claim 1, wherein the retaining hole extends completely through the housing recess, and wherein the retaining hole is threaded above and below the housing recess.

4. The slide assembly of claim 1, wherein the extractor assembly is positioned distal from an intersection between the retaining hole and the housing recess.

5. The slide assembly of claim 1, wherein the slide defines a stopper bore intersecting the housing recess distal from the retaining hole.

6. The slide assembly of claim 5, wherein a stop is positioned within the stopper bore, and wherein the extractor assembly contacts the stop.

7. The slide assembly of claim 1, wherein:

the extractor assembly comprises an extractor and a biasing member; and the biasing member extends proximally in the mounting recess from the extractor towards the retaining hole.

8. The slide assembly of claim 7, wherein the extractor assembly further comprises a plunger positioned between the extractor and the biasing member.

9. A firearm comprising the slide assembly of claim 1.

10. A slide assembly for a firearm comprising:

an extractor assembly including a distal end for engaging a cartridge and a proximal end; and a slide having a top side, a bottom side, a proximal end, a mounting recess about the top side of the slide, a housing recess about the proximal end of the slide, and a plurality of retaining holes extending into the mounting recess towards the bottom side of the slide, the extractor assembly positioned within the housing recess, each retaining hole of the plurality of retaining holes positioned between the proximal end of the extractor assembly and the proximal end of the slide, the proximal end of the extractor assembly is positioned at about a mid-portion of the mounting recess.

11. The slide assembly of claim 10, wherein a first retaining hole of the plurality of retaining holes intersects the mounting recess.

12. The slide assembly of claim 11, wherein a stop is positioned within a stopper bore of the slide, and wherein the stop is positioned between the first retaining hole and the extractor assembly.

13. The slide assembly of claim 11, wherein a second retaining hole of the plurality of retaining holes intersects the mounting recess.

14. A firearm comprising the slide assembly of claim 10.

15. A slide assembly for a firearm comprising:

a slide having a top side, a proximal end, a mounting recess about the top side of the slide, and a housing recess about the proximal end of the slide; and an extractor assembly mounted within the housing recess, the extractor assembly comprising a biasing member positioned distal from a mid-point of the mounting recess, the extractor assembly further comprising an extractor, the biasing member extending proximally from the extractor towards the mid-point of the mounting recess.

16. The slide assembly of claim 15, further comprising a stop intersecting the mounting recess, the biasing member positioned between the stop and the extractor.

17. The slide assembly of claim 15, wherein the extractor assembly further comprises a plunger positioned between the extractor and the biasing member.

18. A firearm comprising the slide assembly of claim 15.

* * * * *